United States Patent [19]

Enomoto et al.

[11] Patent Number: 4,515,140

[45] Date of Patent: May 7, 1985

[54] CONTACTLESS IGNITION DEVICE FOR INTERNAL COMBUSTION ENGINES

[75] Inventors: Kiyoshige Enomoto; Masao Iwata, both of Kanagawa, Japan

[73] Assignee: Oppama Kogyo Kabushiki Kaisha, Yokosuka, Japan

[21] Appl. No.: 488,753

[22] Filed: Apr. 26, 1983

[30] Foreign Application Priority Data

Nov. 4, 1982 [JP] Japan ..... 57-193744

[51] Int. Cl.[3] ..... F02P 3/06; F02P 1/00; F02P 1/17

[52] U.S. Cl. ..... 123/603; 123/594; 123/596; 123/601; 123/605

[58] Field of Search ..... 123/603, 594, 596, 601, 123/5

[56] References Cited

U.S. PATENT DOCUMENTS

| | | | |
|---|---|---|---|
| 3,739,759 | 6/1973 | Sleder | 123/603 |
| 3,824,976 | 7/1974 | Katsumata et al. | 123/603 |
| 3,865,092 | 2/1975 | Schmaldienst | 123/603 |
| 3,900,016 | 8/1975 | Haubner et al. | 123/603 |
| 3,911,886 | 10/1975 | Nagasawa | 123/603 |
| 3,911,889 | 10/1975 | Nagasawa | 123/603 |

*Primary Examiner*—Raymond A. Nelli
*Attorney, Agent, or Firm*—Murray Schaffer

[57] ABSTRACT

A contactless ignition device for internal combustion engines comprising an exciter coil and pulser coil inducing voltages of phases reverse to each other with the rotation of the internal combustion engine, a first capacitor and second capacitor charged with voltages induced by the respective coils and switching elements connected in series in a circuit connecting the first capacitor with an ignition coil so as to conduct the voltage discharged by the second capacitor when either of both induced voltages reaches a set level. A control circuit controlling the switching time of the switching elements is connected to the switching elements so as to delay the operation of the second switching element with the control circuit in the low speed operation range of the engine and to advance the operation in the high speed operation range. This control circuit includes a switching element operating in response to the voltage inducing state of the exciter coil or pulser coil.

5 Claims, 4 Drawing Figures

CONTACTLESS IGNITION DEVICE FOR INTERNAL COMBUSTION ENGINES

FIELD OF THE INVENTION

This invention relates to contactless ignition devices feeding high voltage currents to spark plugs of internal combustion engines and more particularly to a contactless ignition device for internal combustion engines wherein the ignition timing is controlled with a pulser coil provided on the same iron core as of an exciter coil and a control circuit connected to the pulser coil.

BACKGROUND OF THE INVENTION

A magnet generator type ignition device is extensively adopted for such internal combustion engines as, for example, for chain saws and special vehicles. Its purpose is to obtain an ignition current source of high voltage instead of employing a battery. A low voltage current generated the magnet generator is taken, is increased in voltage by an ignition coil and is fed to the spark plug.

Now, in the constant operation of such internal combustion engine as of a chain saw, the ignition time is set near 30 degrees before the top dead center so that the combustion efficiency of the gaseous mixture may be at its maximum. Therefore, when the rotating speed of the internal combustion engine is low as at the time of starting the engine, if the ignition is made at the same ignition time as is mentioned above, the internal combustion engine may rotate reversely, making the starting difficult. That is to say, there have been problems that, when the rotating speed of the engine is low, if the ignition occurs near 30 degrees before the top dead center, the piston will fall before it reaches the top dead center, a force will act to push back the crank and a force to reversely rotate the engine will be created.

BRIEF SUMMARY OF THE INVENTION

The present invention is to provide a contactless ignition device for internal combustion engines wherein the ignition time is delayed so as to ball, for example, in the vicinity of 10 degrees before the top dead center daring the low speed rotation range, as at the time of starting the internal combustion engine, to improve the startability. The timing is advanced in a set rotation range after the engine starts.

Therefore, the present invention is formed of an exciter coil and pulser coil inducing voltages reverse to each other with the rotation of the internal combustion engine. A first capacitor is charged with the voltage induced by the exciter coil, and an ignition coil receives the voltage discharged by the first capacitor. A second capacitor is charged with the voltage induced by the above mentioned pulser coil, and a first switching element conducting the voltage discharged by the second capacitor. A second switching element enables the discharge of the above mentioned first capacitor with the conduction of the first switching element. A third switching element conducts the voltage above a set rotating speed of the engine and makes the above mentioned first or second switching element conduct the voltage.

Therefore, the first switching element or third switching element is selectively made to conduct the voltage in response to the state of the voltage induced by the exciter coil or pulser coil and the conduction of the second switching element and the timing of the conduction are controlled with the conduction of either of the first and third switching elements. The discharged current is made to flow from the first capacitor to the ignition coil by the conduction of the second switching element.

DETAILED DESCRIPTION OF THE INVENTION

Figure 1:
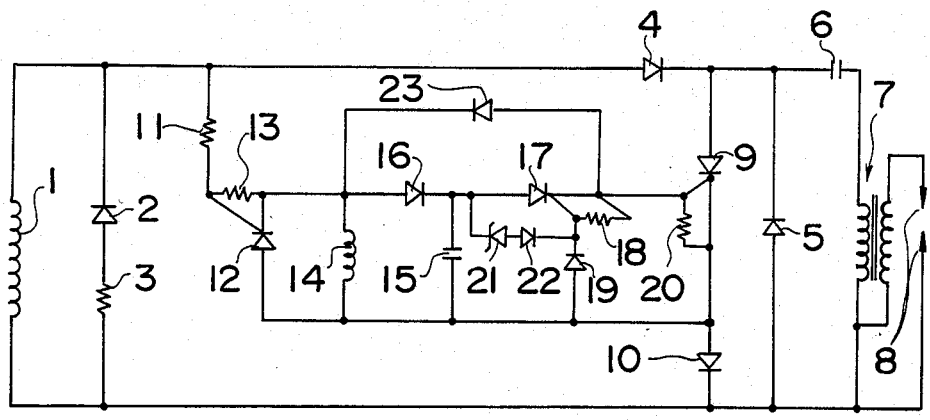
FIG. 1 is a circuit diagram of an ignition device for internal combustion engines accordint to the present invention.

In FIG. 1 a contactless ignition device of the present invention is shown in which the reference numeral 1 denotes an exciter coil with which a series curcuit of a diode 2 and resistance 3 is connected in parallel. As illustrated, connected in parallel with this exciter coil 1 is a reverse flow preventing diode 5 through a diode 4 and the primary side of an ignition coil 7 through a charged and discharged capacitor 6. By the way, a spark plug 8 is connected to the secondary side of the ignition coil 7. Also, a series circuit of a second thylristor 9 which is a second switching element and diode 10 is connected in parallel with the above mentioned diode 5.

On the other hand, a resistance 11 is connected at one end between the exciter coil 1 and diode 4 and at the other end to the cathode of a thylristor 12 through the gate of the thylristor 12 and a resistance 13. The anode of the thylristor 12 is connected to one end of the ignition coil 7 through the above mentioned diode 10. The reference numeral 14 denotes a pulser coil connected in parallel with the thylristor 12, and 15 denotes a second charged and discharged capacitor connected in parallel with this pulser coil 14 through a diode 16. a first thyristor 17, which is a first switching element having the anode and cathode is connected between the diode 16 and the gate of the above mentioned second thylristor 9. A resistance 18 is connected between the cathode and gate of the first thylristor 17 and a diode 19 is connected between the same gate and the diode 10. Further, the reference numeral 20 denotes a resistance connected between the cathode and gate of the second thylristor 9. A zener diode 21 which is a third switching element and a diode 22 has its series circuit connected between the anode and gate of the first thylristor 17. The reference numeral 23 denotes a diode connected between the cathode of the thylristor 17 and one end of the pulser coil 14.

Figure 2:
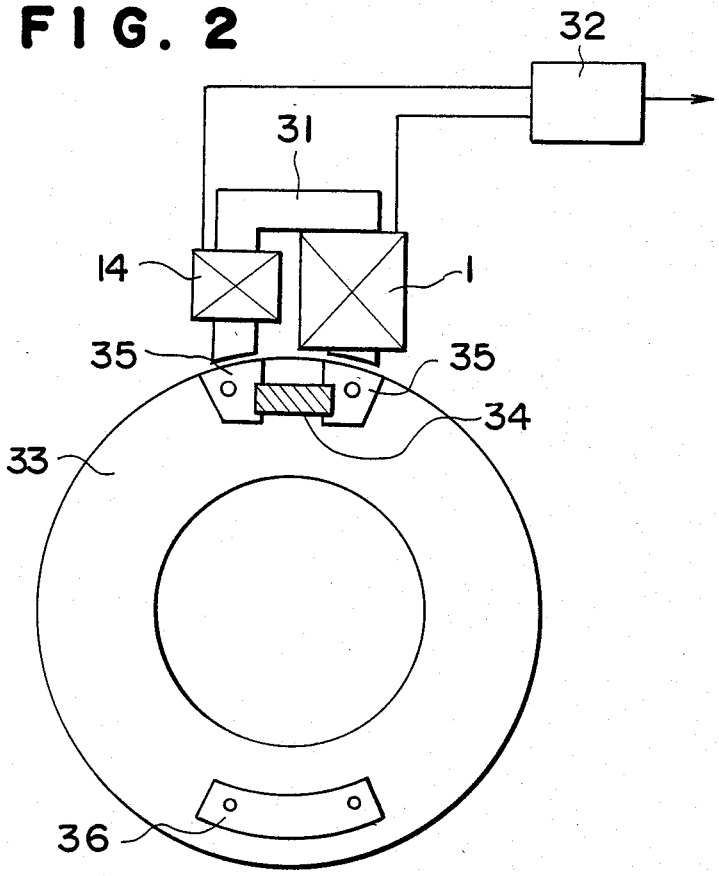
FIG. 2 is a schematic formation view of a magnet generator in the present invention.

In FIG. 2 a magnet generator including the above mentioned exciter coil 1 and pulser coil 14 is shown. These respective coils 1 and 14 are wound as divided into two poles on a U-shaped iron core 31 and are connected at the respective lead ends to the respective parts in FIG. 1 in a control circuit 32. The reference numeral 33 denotes a rotor rotating synchronously with the internal combustion engine and provided with a magnet 34 within it having magnetic poles 35 on the outer peripheral surface. In the drawing, the reference numeral 36 denotes a balance weight.

The operation of this contactless ignition circuit shall be described in the following.

Figure 3:
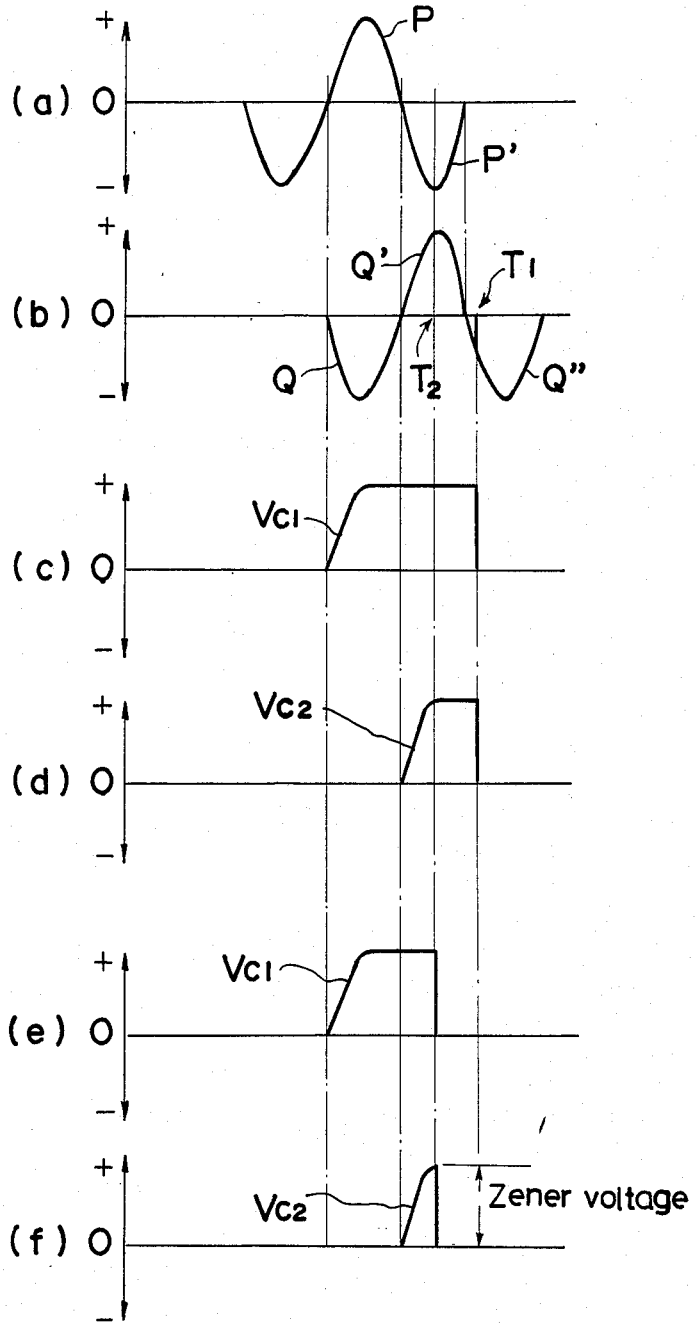
FIGS. 3(*a*), (*b*), (*c*), (*d*), (*e*) and (*f*) are time charts of signals of the respective parts of the above mentioned circuit diagram.

First of all, when the internal combustion engine is started, the rotating speed of this engine will be so low that the above mentioned exciter coil 1 and pulser coil 14 will generate voltages shown in FIGS. 3(*a*) and (*b*). In the positive half cycle of the exciter coil 1, a positive voltage P will charge the first capacitor 6; will flow through the resistance 11, pulser coil 14, diode 10, resistance 11, diode 16, second capacitor 15 and diode 10 in the order mentioned; will charge the second capacitor 15; and will trigger the thylristor 12 on the other hand.

At this time, a negative voltage Q will be generated in the pulser coil 14 but will flow in the normal direction through the triggered thylristor 12 and will be consumed.

Then, in the negative half cycle of the exciter coil 1, a negative voltage P′ will flow in the normal direction through the diode 2 and resistance 3 and will be consumed. At this time, a positive voltage Q′ will be generated in the pulser coil 14 and will charge the capacitor 15 through the diode 16.

Here, when a negative voltage Q″ is generated in the above mentioned pulser coil 14, as the thylristor 12 is off, the negative voltage Q″ will flow through the diode 19, gate and cathode of the thylristor 17, resistance 18 and diode 23 and will trigger the gate of the first thylristor 17. Therefore, the voltage charging the second capacitor 15 will trigger the gate of the second thylistor 9 through the first thylristor 17 to make it conductive. As a result, the voltage charging the first capacitor 6 will be discharged to the primary side of the ignition coil through the second thylristor 9 and diode 10 and, with it, a high voltage will be induced on the secondary side to generate a spark in the spark plug 8. By the way, at the time $T_1$ in FIG. 3(*b*), the negative voltage Q″ of the pulser coil 14 will reach the trigger level of the first thylristor to set it on and the voltage charging the second capacitor 15 will be discharged to the gate of the second thylristor 9 to set it on. Only at this time point $T_1$, will the first capacitor 6 be discharged. FIGS. 3(*c*) and (*d*) show the characteristics of the voltages $V_{c1}$ of the capacitor 6 and $V_{c2}$ of the capacitor 15 at this time.

Such igniting operation will be delayed to a point in the vicinity of 10 degrees before the top dead center of the internal combustion engine to improve the startability of the engine.

On the other hand, when the engine reaches a number of revolutions above a predetermined set value of the advance angle, the positive voltage Q′ of the above mentioned pulser coil 14 will rise to be above the zener voltage of the zener diode 21 at the time point $T_2$. Therefore, the positive voltage Q′ will be added directly to the gate of the first thylristor 17 throught the diode 16, zener diode 21 and diode 22 to set the the first thylristor 17 on. Therefore, the voltage charging the second capacitor 5 will be discharged to the gate of the second thylristor 9 to set it on. Therefore, the voltage charging the above mentioned capacitor 6 will flow to the ignition coil 7 through the thylristor 9 and diode 10 to induce a high voltage on the secondary side of the ignition coil 7 in the same manner as is mentioned above. FIGS. 3(*e*) and (*f*) show the characteristics of the voltages $V_{c1}$ of the capacitor 6 and $V_{c2}$ of the capacitor 15 at this time. Therefore, the discharge of the first capacitor 6 will be advanced to the time point $T_2$ from $T_1$ as in FIG. 3(*e*). That is to say, the trigger timing of the second thylristor 9 at the time point $T_1$ at the time of the low speed rotation will be advanced to the time point $T_2$ above the set number of revolutions, the ignition will be made near 30 degrees before the top dead center of the internal combustion engine and the engine will be able to be driven at a high efficiency.

Thus, in the present invention, particularly the startability of an internal combustion engine can be improved and favorable operation characteristics can be obtained over the entire rotation range of the engine.

Figure 4:
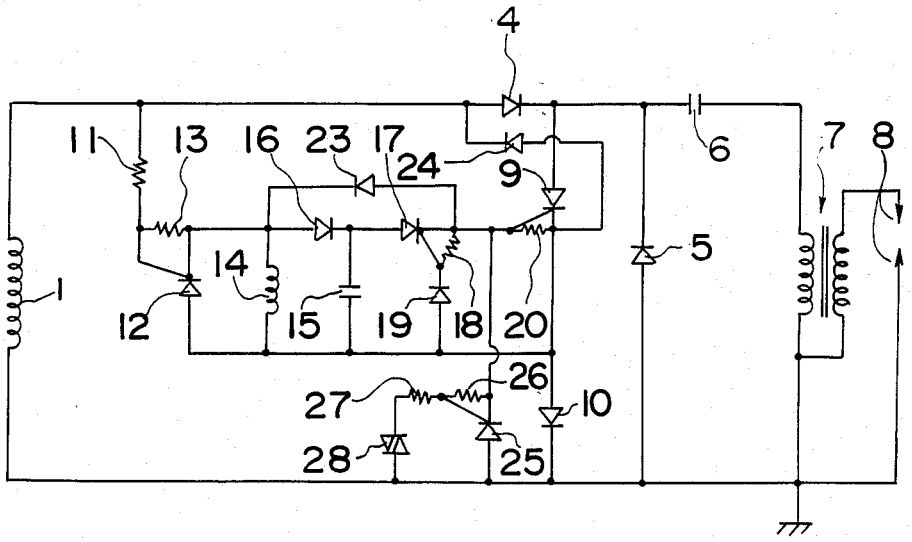
FIG. 4 is a circuit diagram showing another embodiment of the present invention.

FIG. 4 shows another embodiment of the present invention wherein the over rotation of the internal combustion engine in the above mentioned circuit is prevented.

In FIG. 4, the reference numeral 1 denotes an exciter coil connected with a diode 5 through a diode 4 and with the primary side coil of an ignition coil 7 through the diode 4 and a first capacitor 6. A spark plug 8 is connected to the secondary side coil of the ignition coil 7.

A resistance 11 is connected at one end to the middle point of the connection of the exciter coil 1 and diode 4 and at the other end to the cathode through the gate of a thylristor 12 and a resistance 13. The anode of this thylristor 12 is connected to the middle point of the connection of a second thylristor 9 which is a second switching element connected in parallel with the above mentioned diode 5 and the diode 10. The reference numeral 14 denotes a pulser coil connected in parallel with the thylristor 12, 15 denotes a second capacitor connected in parallel with this pulser coil 14 through a diode 16, 17 denotes a first thylristor which is a first switching element having the anode and cathode connected between the diode 16 and the gate of the second thylristor 9. A resistance 18 is connected between the cathode and gate of this first thylristor 17 and a diode 19 is connected between the same gate and diode 10. Further, the reference numeral 20 denotes a resistance connected between the cathode and gate of the second thylristor 9 and a diode 23 is placed in parallel with a series circuit of the diode 16 and the thylristor 17. The reference numeral 24 denotes a diode connected between the middle point of the connection of the above mentioned exciter coil 1 and diode 4 and the cathode of the thylristor 9. A third thylristor 25 which is a third switching element is connected between the cathode of the first thylristor 17 and the ground and 26 denotes a resistance connected between the cathode and gate of this thylristor 25. The reference numerals 27 and 28 denote respectively a resistance and diac connected in series with each other and between the gate and anode of the thylristor 25.

The operation of this contactless ignition circuit whall be described in the following.

FIGS. 3(*a*) and (*b*) show wave forms of voltages generated respectively in the exciter coil 1 and pulser coil 14 by the rotation of the rotor 33. Now, in case the rotating speed is low as at the time of starting the internal combustion engine, in the positive half cycle of the exciter coil 1, a positive voltage P will charge the first capacitor 6, will flow through the resistance 11, pulser coil 14 and diode 10 and through the resistance 11, diode 16, second capacitor 15 and diode 10, will charge the second capacitor 15 and will trigger the gate of the thylristor 12.

At this time, a negative voltage Q will be generated in the pulser coil 14, will flow in the normal directed through the triggered thylristor 12 and will be maintained in the normal direction in the thylristor 12.

Then, in the negative half cycle, a negative voltage P' will be generated in the exciter coil 1, while a positive voltage Q' will be generated in the pulser coil 14 to charge the second capacitor 15. By the way, at this time, the negative voltage P' of the exciter coil 1 will not be so sufficient as to break over the diac 28.

Here, if a negative voltage Q'' is generated in the above mentioned pulser coil 14, as the thylristor 12 is off, the negative voltage Q'' will flow through the diodes 19 and 23 and will trigger the gate of the first thylristor 17 to make it conductive. Therefore, the voltage charging the second capacitor 15 will trigger the gate of the second thylristor 9 through the first thylristor 17 and will make it conductive. As a result, the voltage charging the first capacitor 6 will be discharged to the ignition coil 7 through the second thylristor 9 and diode 10, therefore a high voltage will be induced in the secondary side coil and a spark will be generated in the spark plug 8. By the way, in FIG. 3(*b*), at the time $T_1$, the negative voltage Q'' of the pulser coil 14 will reach the trigger level of the first thylristor 17 to set it on and the voltage charging the second capacitor 15 will be discharged to the gate of the second thylristor 9 to set it on. Only at this time point $T_1$, the first capacitor 6 will be discharged. FIGS. 3(*c*) and (*d*) show characteristics of terminal voltages $V_{c1}$ of the first capacitor 6 and $V_{c2}$ of the second capacitor 15 at this time.

Thus the igniting operation will be delayed to fall into the vicinity of 10 degrees before the top dead center of the internal combustion engine and the startability of the engine will be improved.

On the other hand, when the number of revolutions of the internal combustion engine exceeds a predetermined advance angle of set value, in the negative half cycle of the voltage induced by the exciter coil 1, the voltage P' will rise, therefore the above mentioned diac 28 will be broken over and the gate of the third thylristor 25 will be triggered through the resistance 27. Therefore, the third thylristor 25 will be conductive and the gate of the second thylristor 9 will be also triggered through it so as to be conductive. The voltage charging the first capacitor 6 will flow to the primary side of the ignition coil 7 through the thylristor 9 and diode 10 and therefore a high voltage will be induced on the secondary side.

As a result, the triggering position of the second thylristor 9 will advance to the position $T_2$ as shown in FIG. 3(*e*) from $T_1$ at the time of the low speed rotation. The ignition timing will be near 30 degrees before the top dead center and the internal combustion engine will be able to be driven at a high efficiency point.

Then, when the internal combustion engine rotates at a higher speed above a set over rotation range, the voltage induced by the exciter coil 1 will now reduce. Therefore, the negative voltage P' of the exciter coil 1 will also reduce to be below the break-over voltage of the diac 28, the above mentioned third thylristor 3 will not be triggered and the above mentioned second thylristor 9 will be triggered at the same timing $T_1$ as at the already mentioned low rotation time. As a result, the ignition time will be delayed, the internal combustion engine will return, to be within a rated rotation range, and such accident as the seizure of the bearing by over rotations will be prevented.

As described above in detail, the present invention is formed of an exciter coil and pulser coil inducing voltages of phases substantially reverse to each other in response to the rotation of the internal combustion engine, the exciter coil being connected with a first capacitor charged with the voltage induced by the exciter coil and an ignition coil receiving the voltage discharge by this first capacitor and the pulser coil being provided with a second capacitor charged with the voltage induced by this pulser coil, a first switching element conducting the voltage discharged by this second capacitor, a second switching element enabling the discharge of the above mentioned first capacitor with the conduction of this first switching element and a third switching element making the above mentioned first switching element or second switching element conductive by being conductive above a set number of revolutions of the internal combustion engine. Therefore, there can be obtained such effects that the internal combustion engine can be improved in the startability and can make the same high efficiency operation as before.

We claim:

1. A contactless ignition device for internal combustion engines comprising an exciter coil and pulser coil inducing voltages of phases substantially reverse to each other in response to the rotation of the internal combustion engine, a first capacitor charged with the voltage induced by the exciter coil, an ignition coil feeding a high voltage to a spark plug by receiving the voltage discharge by said first capacitor, a second capacitor charged with the voltage induced by said pulser coil, a first switching element conducting the voltage discharged by said second capacitor, a second switching element enabling the discharge of said first capacitor with the conduction of said first switching element and a third switching element making said first switching element or second switching element conductive by being conductive at a set constant rotating speed of the internal combustion engine.

2. A contactless ignition device for internal combustion engines according to claim 1 characterized in that said exciter coil and pulser coil are wound on the same iron core and are set as opposed to a rotor fitted with a magnet and rotating synchronously with the internal combustion engine.

3. A contactless ignition device for internal combustion engines according to claim 1 characterized in that said first switching element and second switching element are thylristors.

4. A contactless ignition device for internal combustion engines according to claim 1 characterized in that said third switching element is a zener diode connected between the anode and gate of the first thylristor so as to operate above a set value of the voltage induced by the pulser coil.

5. A contactless ignition device for internal combustion engines according to claim 1 characterized in that said third switching element is made to control the operation of the second switching element in response to the voltage induced in the negative half cycle of the exciter coil.

* * * * *